US008966945B1

(12) United States Patent
Buechel

(10) Patent No.: US 8,966,945 B1
(45) Date of Patent: Mar. 3, 2015

(54) CARTING CONTAINER ANTI-THEFT DEVICE

(71) Applicant: Thomas Buechel, Hoboken, NJ (US)

(72) Inventor: Thomas Buechel, Hoboken, NJ (US)

( * ) Notice: Subject to any disclaimer, the term of this patent is extended or adjusted under 35 U.S.C. 154(b) by 2 days.

(21) Appl. No.: 14/047,886

(22) Filed: Oct. 7, 2013

(51) Int. Cl.
*E05B 73/00* (2006.01)

(52) U.S. Cl.
CPC ..... *E05B 73/0023* (2013.01)
USPC ..... 70/14; 70/18; 70/19; 70/58; 70/258; 280/507

(58) Field of Classification Search
USPC ..... 70/14, 18, 19, 57, 58, 200, 203, 209, 70/212, 232, 258; 248/551–553; 280/507, 280/510
See application file for complete search history.

(56) References Cited

U.S. PATENT DOCUMENTS

| | | | | |
|---|---|---|---|---|
| 1,453,882 | A * | 5/1923 | McHugh | 70/18 |
| 4,836,570 | A * | 6/1989 | Lopez et al. | 280/507 |
| 5,636,538 | A * | 6/1997 | Openiano | 70/209 |
| 5,713,229 | A * | 2/1998 | Garcia et al. | 70/209 |
| 5,782,115 | A * | 7/1998 | Judy | 70/164 |
| 5,794,961 | A * | 8/1998 | Niswanger | 280/507 |
| 6,112,560 | A * | 9/2000 | Mabee | 70/14 |
| 6,802,523 | B1 * | 10/2004 | Profitt | 280/507 |
| 6,832,709 | B2 * | 12/2004 | Henry | 224/403 |
| 6,932,376 | B1 * | 8/2005 | Profitt | 280/507 |
| 2004/0017061 | A1 * | 1/2004 | Roberts | 280/507 |
| 2006/0272365 | A1 * | 12/2006 | Copus | 70/14 |
| 2007/0108732 | A1 * | 5/2007 | Silva, II | 280/507 |

OTHER PUBLICATIONS

Welcome to BoxLox, http://boxlox.org/index.php (last downloaded on Oct. 7, 2013).
BoxLox—About Us, http://boxlox.org/About-us.php (last downloaded on Oct. 7, 2013.

* cited by examiner

*Primary Examiner* — Lloyd Gall
(74) *Attorney, Agent, or Firm* — Weitzman Law Offices, LLC

(57) ABSTRACT

An anti-theft device for use on a hook of a carting container, the device comprising: an engagement unit including a shaft dimensioned to occupy an engagement portion of the hook, a first plate coupled to one end of the shaft, and having a passageway associated therewith, and a second plate coupled to an other end of the shaft, a retaining bar including a stop plate, a locking arm having at least one hole therein dimensioned to accept a lock shackle, the locking arm being dimensioned such that a distal end of the locking arm can be inserted through the passageway, the locking arm further having a length such that, when the distal end has been inserted through the passageway, the stop plate will be on one side of the engagement unit and the at least one hole will be on the other side of the engagement unit.

20 Claims, 9 Drawing Sheets

CARTING CONTAINER ANTI-THEFT DEVICE

FIELD OF THE INVENTION

This application generally relates to carting containers and, more particularly, to reducing theft or improper removal of carting containers.

BACKGROUND

Carting containers, also called roll-off containers or dumpsters, are used to remove volumes of waste from a particular location. It is not uncommon in the carting industry for such containers to be misplaced or accidentally pulled by the wrong hauler. In addition, if the container contains a sufficient amount of valuable material like copper wire from a building demolition or other salable material, the container can be an attractive target for theft by an unscrupulous hauler.

Thus, there is a need in the carting container field for a device that provides a better way to address the above problems by reducing the ability of someone other than the proper hauler to pull the container onto their truck for removal.

SUMMARY

An anti-theft device for use on a hook affixed to a plate of a carting container is described. One example implementation of the anti-theft device is made up of an engagement unit including a shaft dimensioned to occupy an engagement portion of the hook, a first plate coupled to one end of the shaft. The first plate includes an associated passageway. A second plate is coupled to an other end of the shaft. The anti-theft device is also made up of a retaining bar including a stop plate, a locking arm, coupled to the stop plate, having at least one hole therein dimensioned to accept a shackle of a lock. The locking arm is dimensioned in transverse cross section such that a distal end of the locking arm can be inserted into and through the passageway of the engagement unit. The locking arm has a length such that, when the distal end has been inserted through the passageway, the stop plate will be on one side of the engagement unit and the at least one hole will be on the other side of the engagement unit.

Other example implementations are also described in conjunction with some of the advantages that can be obtained through use of the teachings herein to implement an anti-theft device according to the present claims.

The advantages and features described herein are a few of the many advantages and features available from representative embodiments and are presented only to assist in understanding the invention. It should be understood that they are not to be considered limitations on the invention as defined by the claims, or limitations on equivalents to the claims. For instance, some of these advantages are mutually contradictory, in that they cannot be simultaneously present in a single embodiment. Similarly, some advantages are applicable to one aspect of the invention, and inapplicable to others. Thus, this summary of features and advantages should not be considered dispositive in determining equivalence. Additional features and advantages of the invention will become apparent in the following description, from the drawings, and from the claims.

DETAILED DESCRIPTION

In simplified overview, embodiments of a device that reduces the likelihood that an unauthorized hauler will pull, or impedes an unscrupulous hauler from stealing, a carting container is described herein. More particularly, the device is designed to impede access to the universal hook up hook by which a hauler would pull the container onto a truck via a cable connected to a winch, boom arm or other standard mechanism for doing so.

Figure 1:
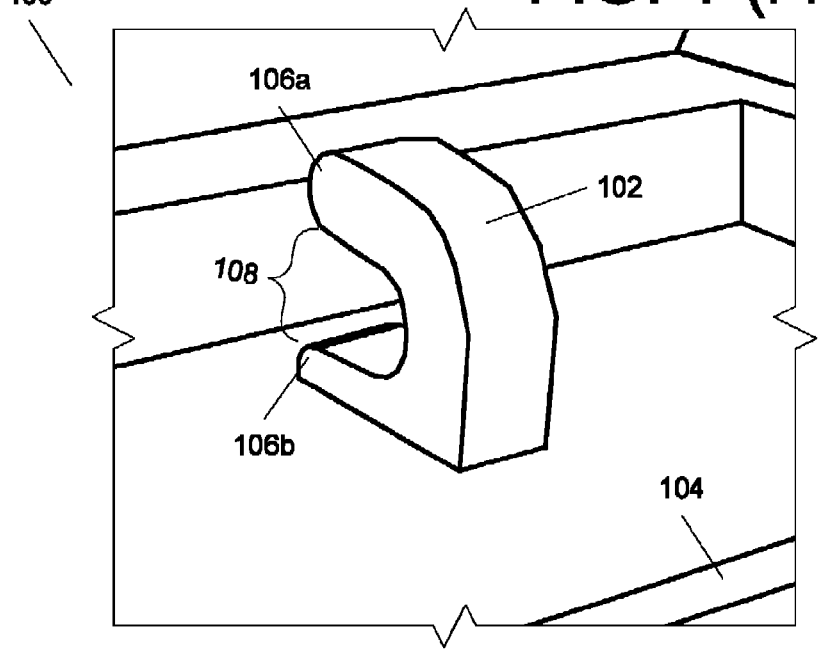
FIG. 1 (Prior Art)
FIG. 1 illustrates, in simplified form, a portion of a prior art carting container containing a universal hook up hook via which the carting container can be loaded onto a truck for removal.

In this regard, FIG. 1 illustrates, in simplified form, a portion 100 of a prior art carting container containing a universal hook up hook 102 via which the carting container can be loaded onto a truck for removal. The hook 102 is formed on, or rigidly secured to, a support plate 104, for example in the latter case, by welding or other appropriate known securing means. The hook 102 is oriented such that its tip(s) 106*a*, 106*b* are pointed towards the rear of the container (i.e. away from the direction the container will be pulled by the winch cable, boom arm or other mechanism to load it onto a truck) such that the gap 108 between the tip(s) 106*a*, 106*b* or the tip

106*a* and the plate 104 can be engaged on the container-side of the hook to load it onto a truck. In addition, as partially shown in the portion 100 of this particular carting container, the hook 102 sits in a recess on the exterior of the container but bounded by the walls of the container and the plate 104.

Figure 2:
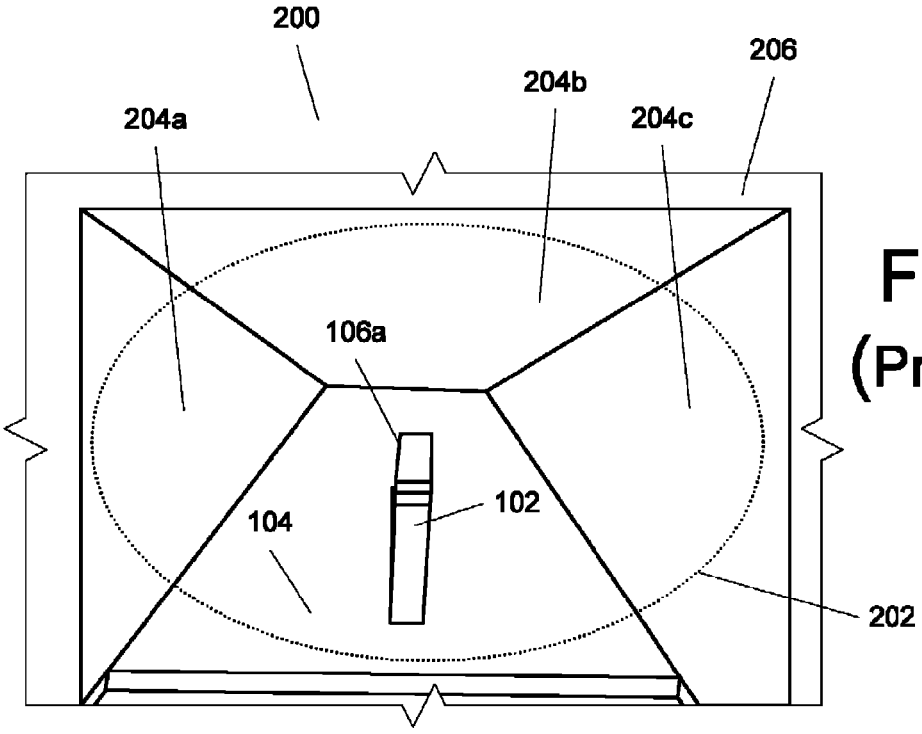
FIG. 2 (Prior Art)
FIG. 2 illustrates, in simplified form, a portion of another prior art carting container containing a universal hook up hook from a greater distance than shown in FIG. 1.

FIG. 2 illustrates, in simplified form, a portion 200 of another prior art carting container containing a universal hook up hook 102 from a greater distance than shown in FIG. 1. As can be better seen in the portion 200, the hook 102 sits in a recessed volume 202 defined by the plate 104 and inwardly extending parts 204*a*, 204*b*, 204*c* of the container's front wall 206 (only part of which is shown for simplicity).

Figure 3:
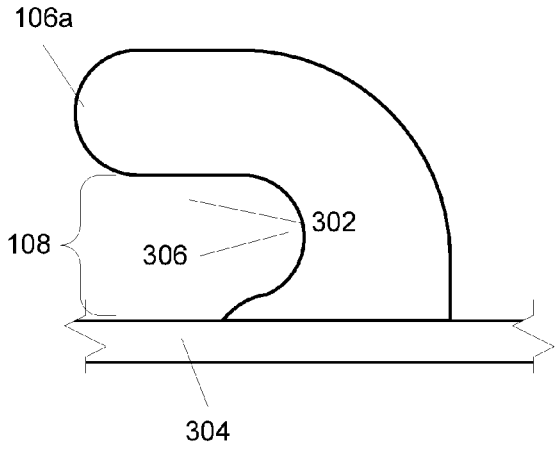
FIG. 3 (Prior Art)
FIG. 3 illustrates, in simplified form, a side view of a universal hook up hook similar to the hooks of FIGS. 1-2 and a portion of the support plate to which it is welded.

FIG. 3 illustrates, in simplified form, a side view of a prior art universal hook up hook 302 similar to the hooks 102 of FIGS. 1-2 and a portion of the support plate 304 to which it is welded. In this view, the gap 108 can easily be seen, as can the engagement portion 306 of the hook 302 (i.e. the part engaged by the by the winch cable, boom arm or other mechanism to load it onto a truck).

With the foregoing understanding, the anti-theft device invention can be described with reference to various specific example implementations. In general, the carting container anti-theft device comprises two parts: an engagement unit and a retaining bar.

FIGS. 4A-4C illustrate, in simplified form, one example implementation of an engagement unit 400 part of the inventive carting container anti-theft device. Specifically, FIG. 4A is a top view of the engagement unit 400, FIG. 4B is a front view of the engagement unit 400 and FIG. 4C is a right side view of the engagement unit 400. Note that, in this implementation, the engagement unit 400 is configured such that the opposing side of each view (i.e. bottom, back and left side) would be the minor image of the view shown. As best shown in FIGS. 4A and 4B, the engagement unit 400 is made up of two plates 402, 404, separated by a bar 406. At least one of the two plates 402, 404 includes an associated passageway 408 through which a part of the retaining bar component can be passed, as will be described in greater detail below. In this example implementation, both plates 402, 404 have their own individual passageway 408, although, for other implementations, the device can be fully used with only one passageway 408 in one of the plates. Advantageously, two passageways 408 make for a more versatile engagement unit 400. As can be seen from FIG. 4C in conjunction with FIGS. 4A-4B, the bar 406 separating the plates 402, 404 is, in this implementation, round with a radius selected to conform to a hook engagement portion 306, with this example implementation, of the hook 302 of FIG. 3. In other implementations, the bar 406 could have other shapes, the important aspect being its ability to occupy a portion within the hook between the engagement portion 306 and the entrance of the gap 108 to help prevent connection of a winch, boom arm or other removal device and/or to impede movement of the engagement unit 400 in substantially any direction other than towards the rear of the container.

In a similar vein, FIGS. 5A-5C illustrate, in simplified form, three views of one example implementation of a retaining bar 500 part of the inventive carting container anti-theft device configured for use with the engagement unit 400 of FIGS. 4A-4C. Specifically, FIG. 5A is a top view of the retaining bar 500, FIG. 5B is a side view of the retaining bar 500 and FIG. 5C is a end-on view of the retaining bar 500 viewed in the direction of the arrow "X" in FIG. 5B.

The retaining bar 500 is made up of a locking arm 502 having a transverse cross section closely corresponding to the passageway 408 of the engagement unit 400 with which it will be used (not shown to scale). In addition, the locking arm 502 has a length "L" such that, when inserted into the engagement unit 400 during use on a carting container hook 102, at least one hole (described below) near the distal end 504 of the locking arm 502 will be beyond the end of the engagement unit 400 and, with some implementations, the locking arm 502 will be sufficiently long that, in use, the distal end 504 can be positioned close to or abutting the back wall of the carting container to advantageously prevent a winch cable, boom or other container loading device from bypassing the anti-theft device and indirectly engaging the container's hook 102 or engaging the locking arm 502 of the anti-theft device in a manner similar to the way it would engage the hook.

As noted above, the retaining bar 500 includes at least one, and likely more, holes 501 placed and sized to accept the shackle of a lock close to the engagement unit 400 when the distal end 504 of the locking arm 502 has been inserted into and through the passageway 408 for locking as described in greater detail below. Note that, as shown, the holes are shown as round and are placed near the top of the retaining bar 500. Depending upon the particular implementation, intended lock and available clearances, the hole(s) 501 could be of any shape and dimension that will accept the intended lock shackle and such hole(s) 501 could placed at other places on the retaining bar 500, for example, near the lower edge of the retaining bar 500 (i.e. closer to the part that will be closest to the plate 104 in use) or near its center (provided that the intended lock is able to make use of the hole.

The retaining bar 500 further includes, at an end opposite the distal end 504, a stop plate 508 coupled to the locking arm 502 that limits travel of the locking arm 502 through the passageway 408. As shown, in this implementation, the stop plate 508 is "L-shaped" with the "stem" of the "L" having a length such that that the "leg" 510 of the "L" can slide under the plate 104 of the carting container. Of course in other implementations, the stop plate 508 can have some other shape (for example, one that optionally limits access to the recessed volume 202, inhibits pivoting, or impedes access to other parts of the engagement unit 400), since its primary function is to limit the insertion travel of the locking arm 502.

Figure 4:
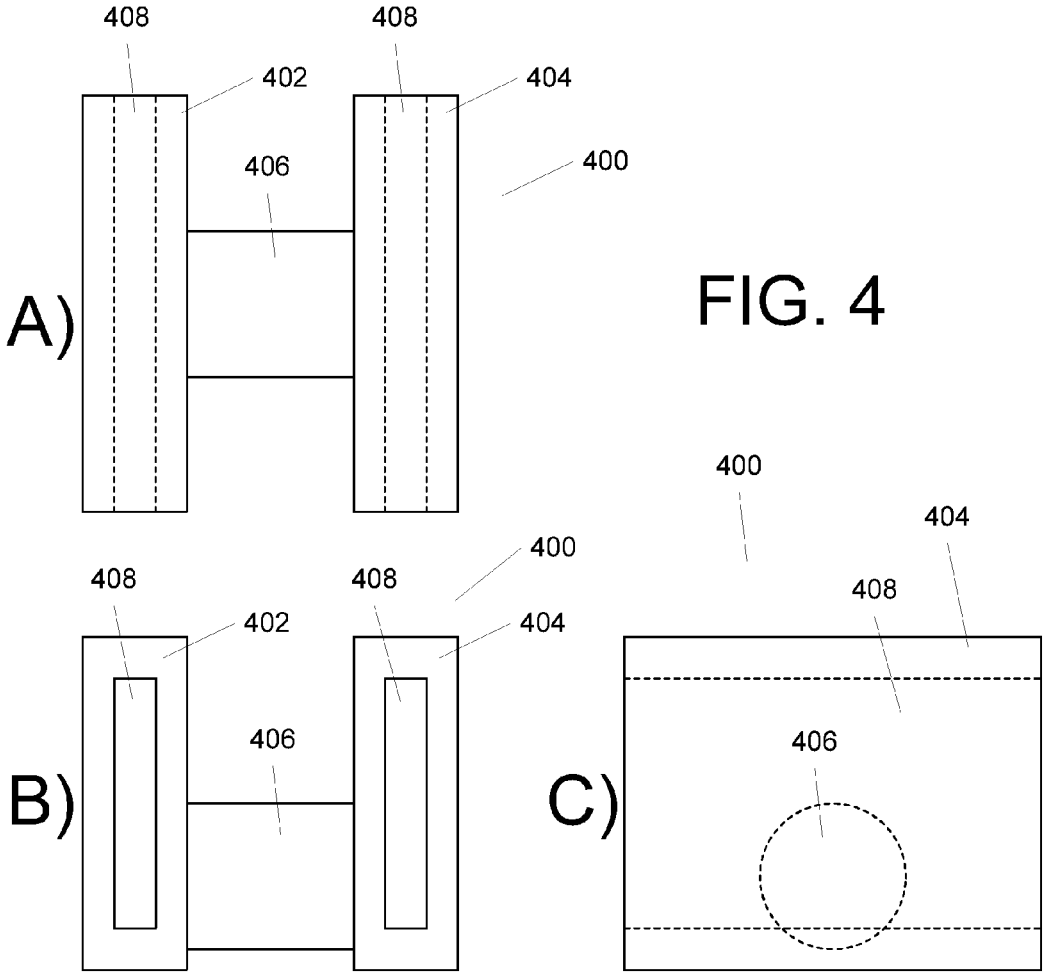
FIGS. 4A-4C illustrate, in simplified form, one example implementation of an engagement unit part of the inventive carting container anti-theft device.
Figure 5:
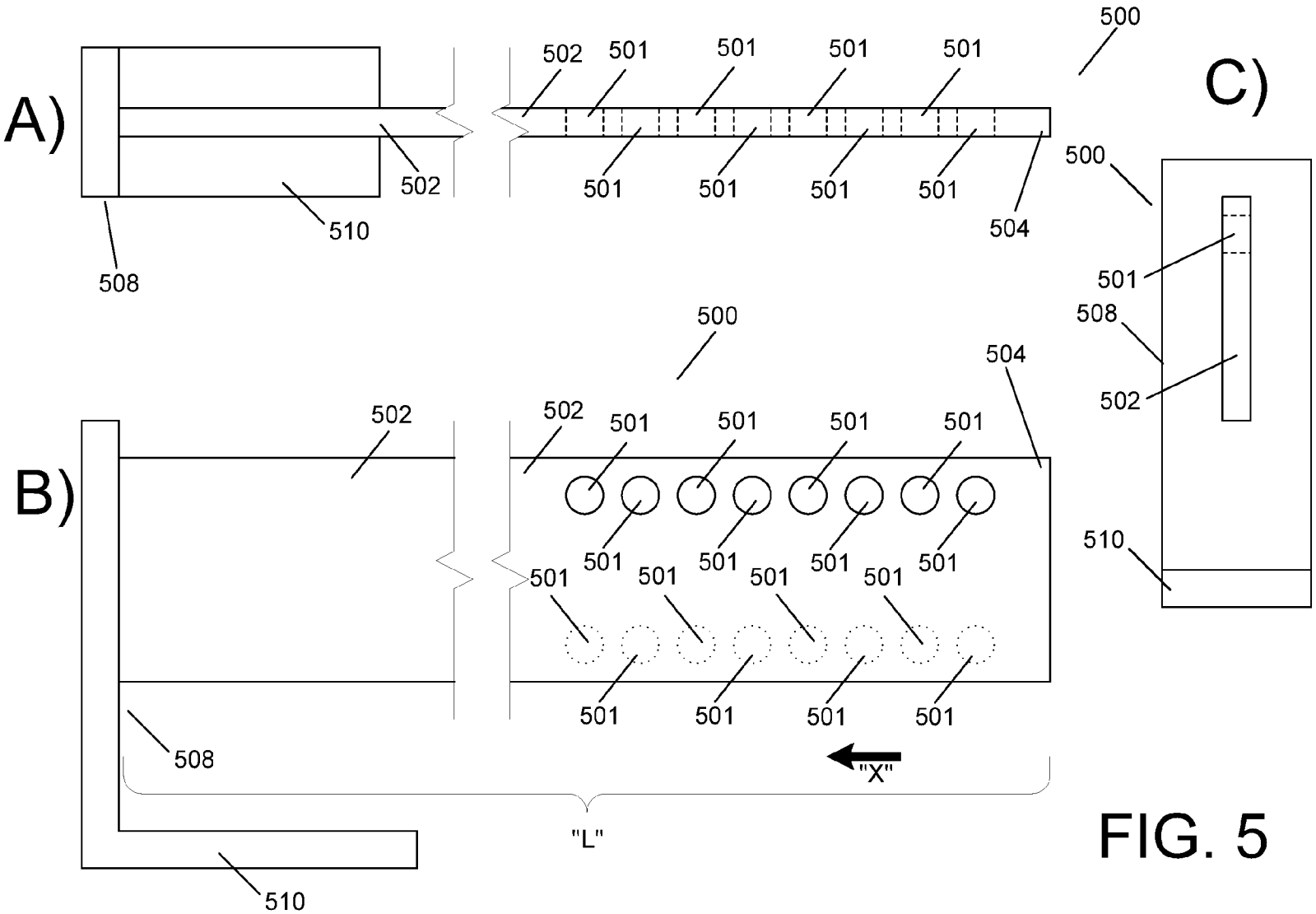
FIGS. 5A-5C illustrate, in simplified form, one example implementation of a retaining bar part of the inventive carting container anti-theft device for use with the engagement unit of FIGS. 4A-4C.
Figure 6:
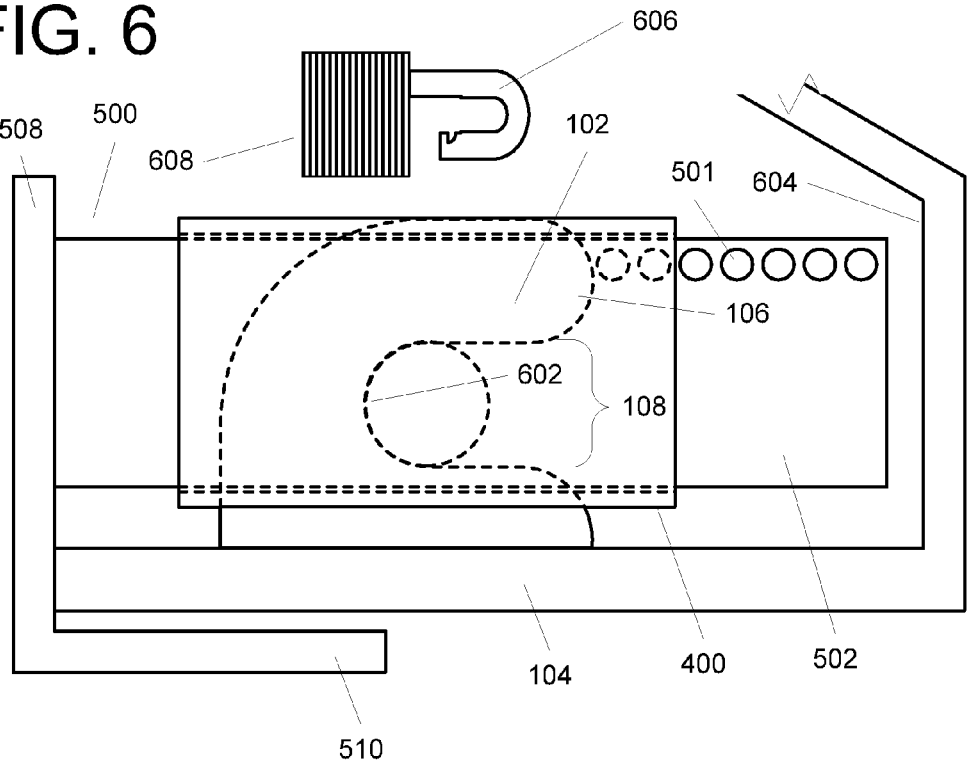
FIG. 6 illustrates, in simplified form, the engagement unit and retaining bar of the example implementation of FIGS. 4-5 installed on a hook of a carting container.

FIG. 6 illustrates, in simplified form, the engagement unit 400 and retaining bar 500 of the example implementation of FIGS. 4-5 installed on a hook 102 of a carting container similar to the containers of FIGS. 1-2. As shown, the engagement unit 400 has been positioned such that the plates 402, 404 are to either side of the hook 102 with the bar 406 abutting the engagement portion 602 of the hook 102. Note here that the dimensions of the plates 402, 404 are such that they extend towards the rear of the container beyond the tip(s) 106 of the hook 102, thereby preventing any access of a winch cable, boom arm or other loading device to the part of the hook 102 between the engagement portion 306 and the entrance of the gap 108. In addition, as shown, the locking arm 502 has been inserted into and through the passageway 408 such that the leg 510 is underneath the support plate 104 and, due to the length of the locking arm 502, the distal end 504 is close to the wall 604 at the back of the hook-containing recess. While in this position, the shackle 606 of a lock 608 can be inserted through one of the holes 501 to prevent withdrawal of the locking arm 502. In addition, advantageously, the stop plate 508 and/or the wall 604 prevent substantial movement of the locking arm 502 in a direction towards the back of the carting container while the shackle 606 concurrently prevents withdrawal of the locking arm 502. Similarly, the stop plate 508 impedes movement of the engagement unit 400 out of the opening 108 in the hook 102 and, in this implementation, the leg 510, being under the support plate 104 (i.e. on a side of the support plate 104 opposite the hook 102), further restricts pivotal movement of the locking arm 502.

Figure 7:
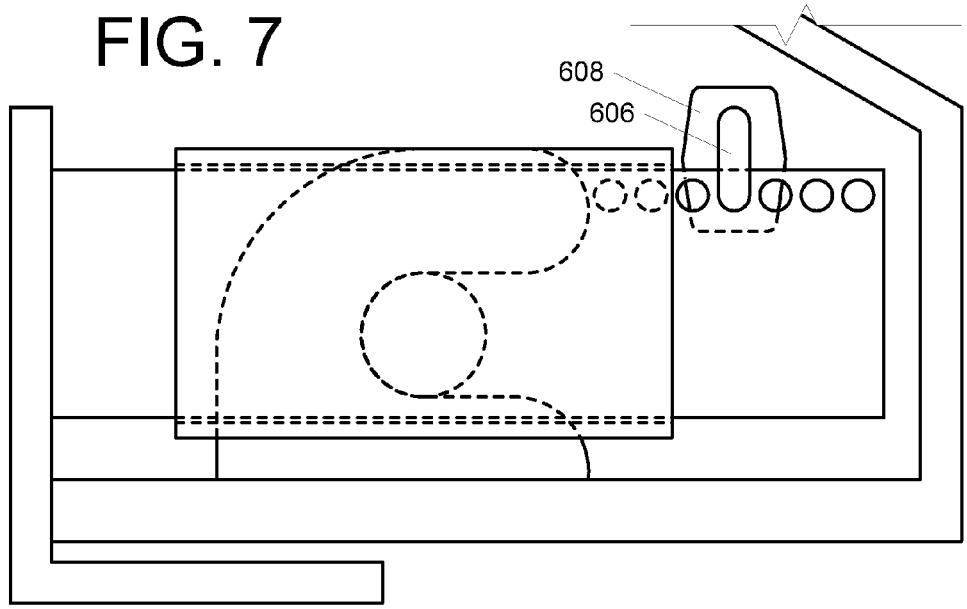
FIG. 7 illustrates, in simplified form, the arrangement of FIG. 6 following insertion of the shackle of the lock into a hole and locking of the lock.

FIG. 7 illustrates, in simplified form, the arrangement of FIG. 6 following insertion of the shackle 606 of the lock 608 into a hole 501 and locking of the lock 608. Once the lock 608 is locked, access to the hook 102 for attaching the removal winch cable, boom arm or other hook engaging element cannot easily be accomplished because, before the hook 102 can be used to move the container, the lock 608 would need to be unlocked or cut off, and the locking arm 502 of the retaining bar 500 would need to be withdrawn such that the engagement unit 400 could be removed.

Advantageously, by locating the holes such that the lock 608 will be in the back portion of the recess containing the hook 102, accessibility to the lock 608 is limited so that cutting using a saw, bolt cutter or torch to defeat the lock or picking the lock becomes more difficult and time consuming, if it can be done at all.

Figure 8:
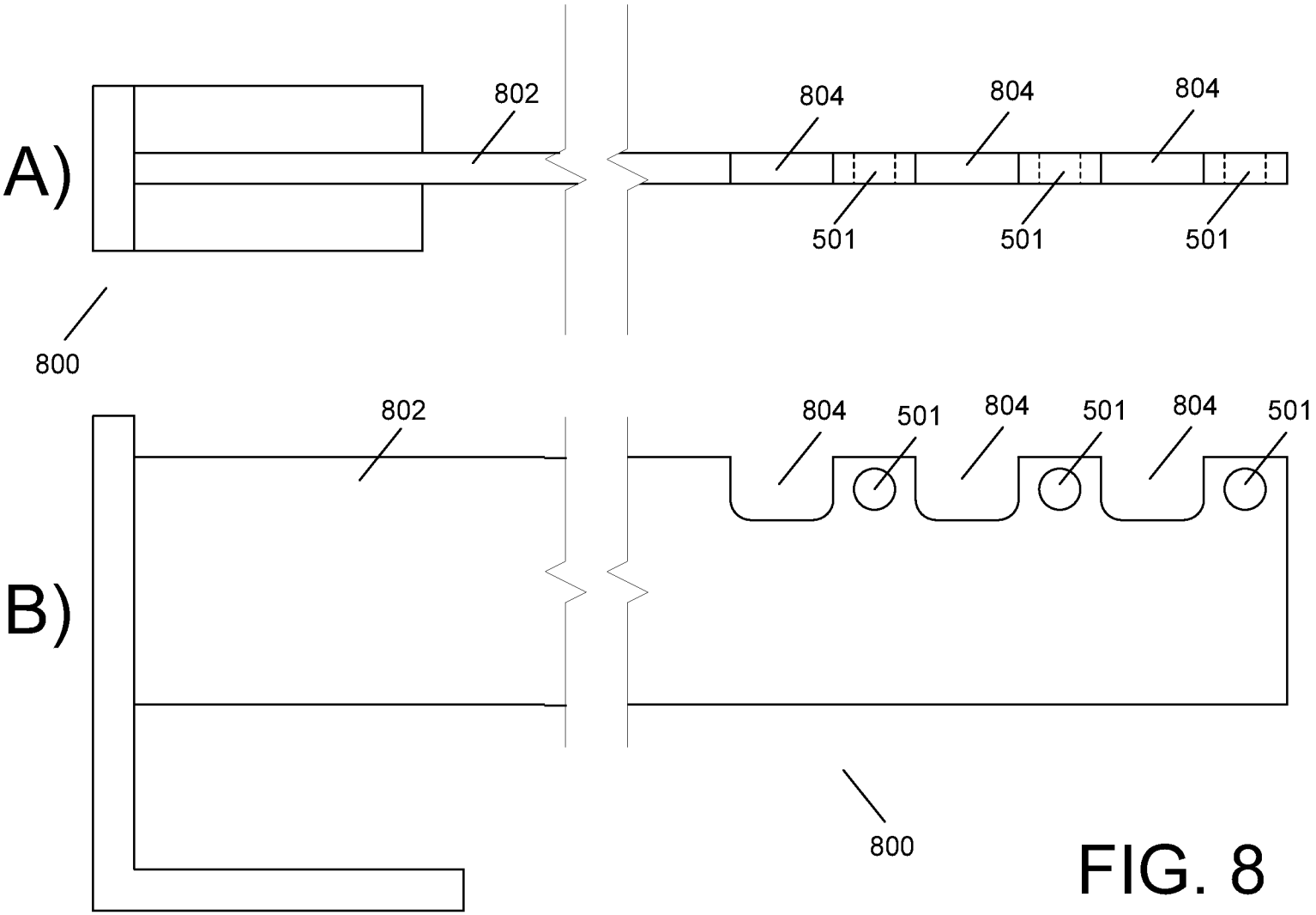
FIGS. 8A-8B respectively illustrate, in simplified form, the top and side views of an alternative implementation retaining bar similar to the retaining bar of FIG. 5 for use with the engagement unit of FIG. 4.

FIGS. 8A-8B respectively illustrate, in simplified form, the top and side views of an alternative implementation retaining bar 800 similar to the retaining bar 500 of FIG. 5 for use with the engagement unit 400 of FIG. 4. As can be seen, with this example implementation, in addition to the holes 501, the locking arm 802 includes one or more notches or cutout areas 804. The notches or cutout areas 804 of this example implementation are configured to allow a hidden shackle lock to be used instead of, as in FIG. 7, a padlock style lock 608.

Figure 9:
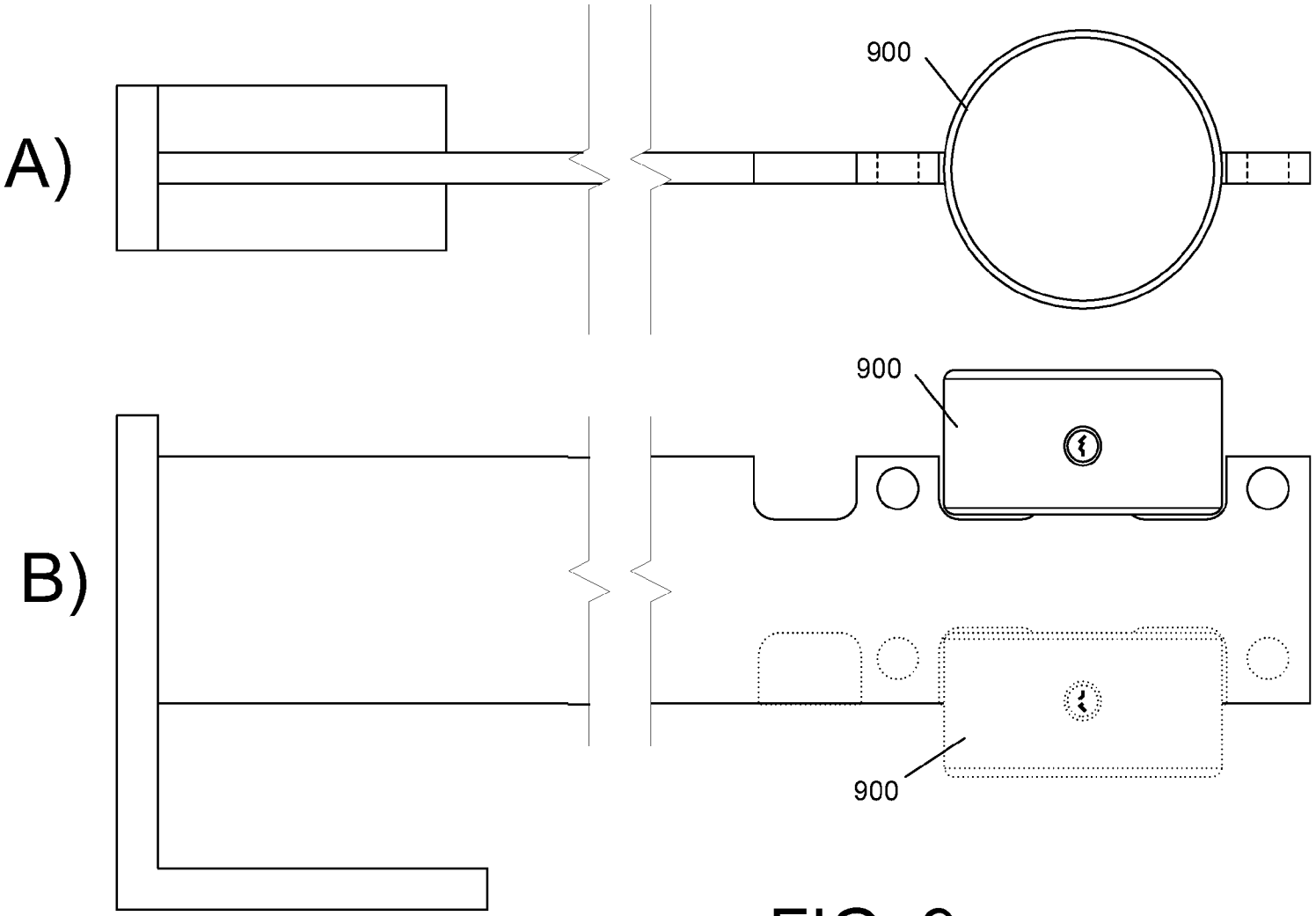
FIGS. 9A-9B respectively illustrate, in simplified form, the top and side views of the alternative implementation retaining bar with an example hidden shackle lock attached.

FIGS. 9A-9B respectively illustrate, in simplified form, the top and side views of the alternative implementation retaining bar 800 with an example hidden shackle lock 900 attached. Note that, for a configuration where the hole(s) 501 and notches or cutout areas 804 are on the bottom edge of the retaining bar 800 (shown in dotted lines), use of a hidden shackle lock 900 will further restrict access.

Figure 10:
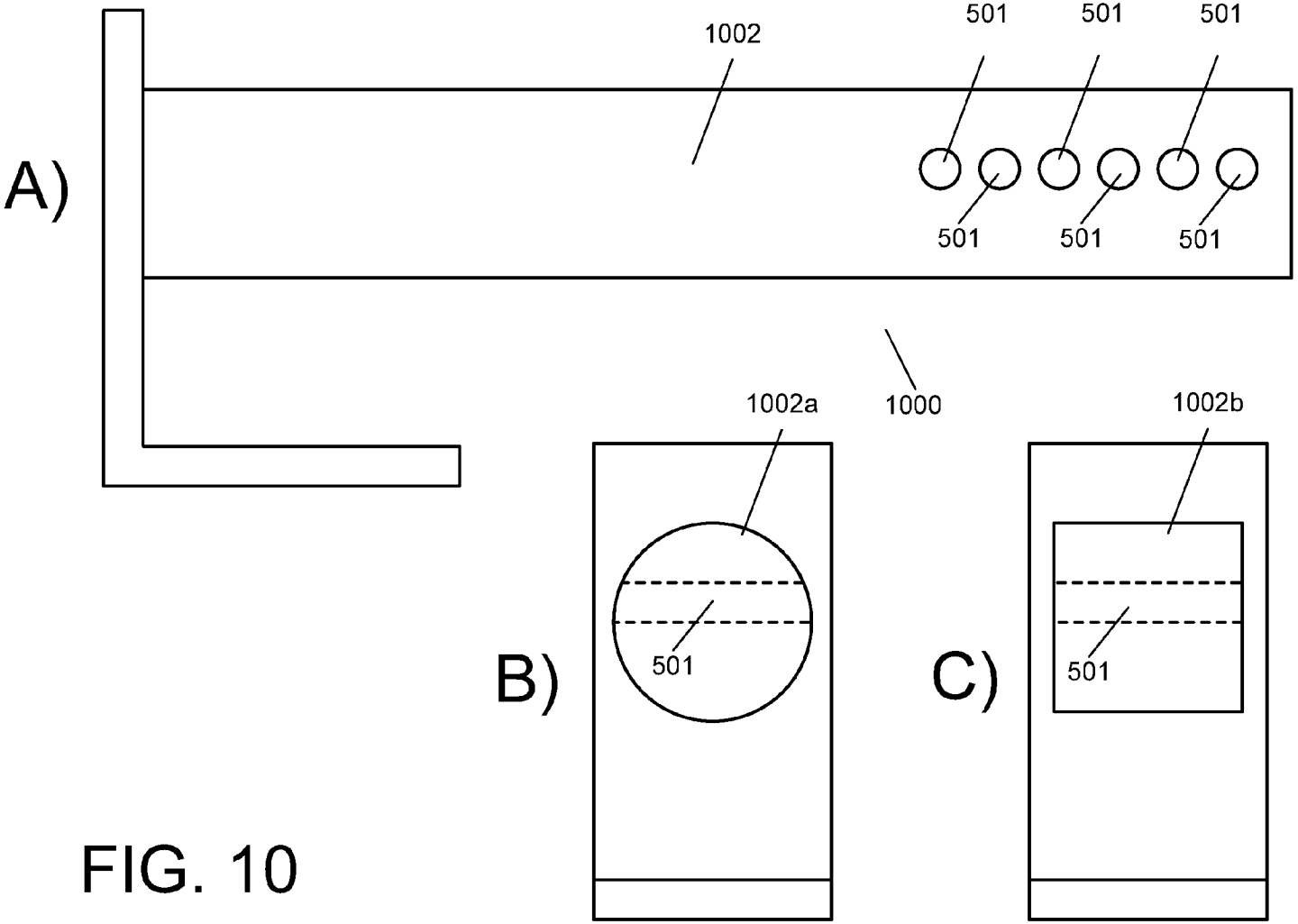
FIG. 10A illustrates, in simplified form, a side view of another alternative implementation retaining bar.
FIG. 10B illustrates the example implementation of FIG. 10A where the transverse cross section of the locking arm is substantially circular in shape.
FIG. 10C illustrates the example implementation of FIG. 10A where the transverse cross section of the locking arm is substantially square in shape.

FIG. 10A illustrates, in simplified form, a side view of another alternative implementation retaining bar 1000. As shown in FIG. 10A, with this example implementation, the locking arm 1002 has an alternative shape in transverse cross section to the substantially rectangular cross section of FIG. 5. FIG. 10B illustrates the example implementation of FIG. 10A where the transverse cross section of the locking arm 1002 is substantially circular 1002*a* in shape. FIG. 10C illustrates the example implementation of FIG. 10A where the transverse cross section of the locking arm 1002 is substantially square 1002*b* in shape.

Other cross sectional shapes for the locking arm can also be used, such as substantially triangular and substantially oval shapes, as well as other regular or irregular shapes, in alternative implementations.

Figure 11:
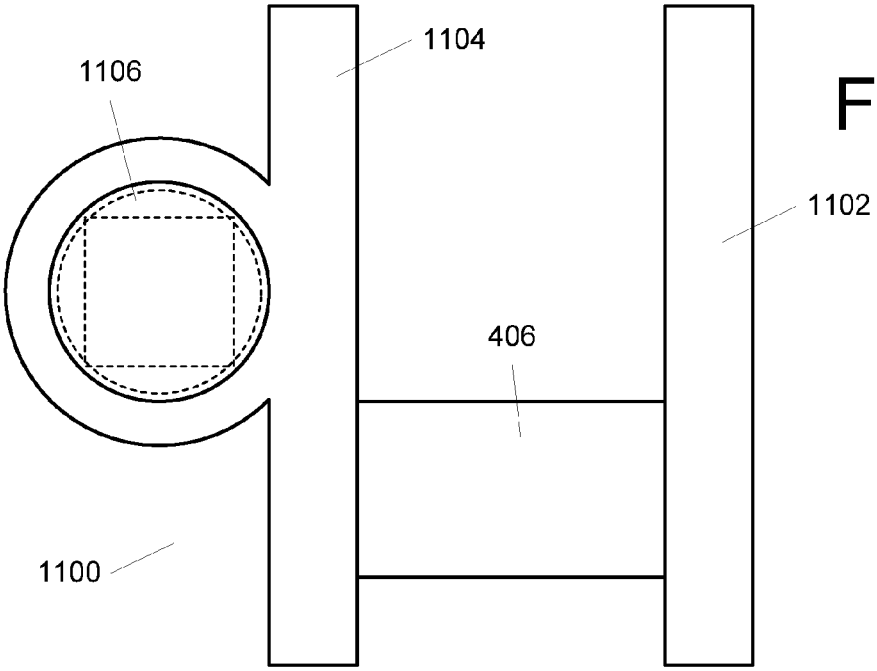
FIG. 11 illustrates, in simplified form, an alternative implementation engagement unit configured for use with a retaining bar implementation such as shown in FIGS. 10A-10B or FIGS. 10A and 10C.

FIG. 11 illustrates, in simplified form, an alternative implementation engagement unit 1100 configured for use with a retaining bar implementation such as shown in FIGS. 10A-10B or FIGS. 10A and 10C. As shown, the engagement unit 1100 is similar to the engagement unit of FIG. 4, in that it has a similar bar 406 to engage a container hook and two plates 1102, 1104 to either side of the bar 406, but differs in that one of the plates 1102 has no passageway at all and the other plate 1104 is configured with a round passageway 1106. Advantageously, depending upon the sizing of the passageway 1106 and the locking arm 1002 with which it will be used, the cross section of the passageway in the engagement unit 1100 and locking arm need not be the same, for example, either the cross section of FIG. 10B or the cross section of FIG. 10C could be accommodated by the engagement unit 1100. This is illustrated in dashed lines in FIG. 11.

Figure 12:
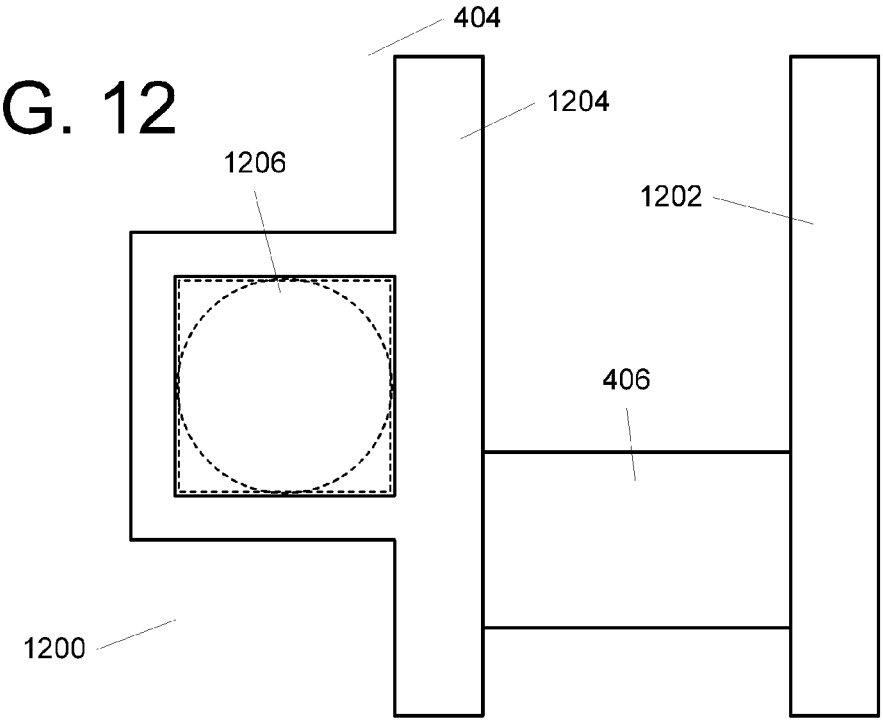
FIG. 12 illustrates, in simplified form, an alternative implementation engagement unit configured for use with a retaining bar implementation such as shown in FIGS. 10A-10B or FIGS. 10A and 10C.

FIG. 12 illustrates, in simplified form, an alternative implementation engagement unit 1200 configured for use with a retaining bar implementation such as shown in FIGS. 10A-10B or FIGS. 10A and 10C. As shown, the engagement unit 1200 is similar to the engagement unit of FIG. 4, in that it has a similar bar 406 to engage a container hook and two plates 1202, 1204 to either side of the bar 406, but differs (like FIG. 11) in that one of the plates 1202 has no passageway at all. In contrast to FIG. 11 however, the other plate 1204 is configured with a square passageway 1206. Advantageously, as with FIG. 11, depending upon the sizing of the passageway 1206 and the locking arm 1002 with which it will be used, the cross section of the passageway 1206 and the locking arm need not be the same, for example, either the cross section of FIG. 10B or the cross section of FIG. 10C could be accommodated. This is illustrated in dashed lines in FIG. 12.

Figure 13:
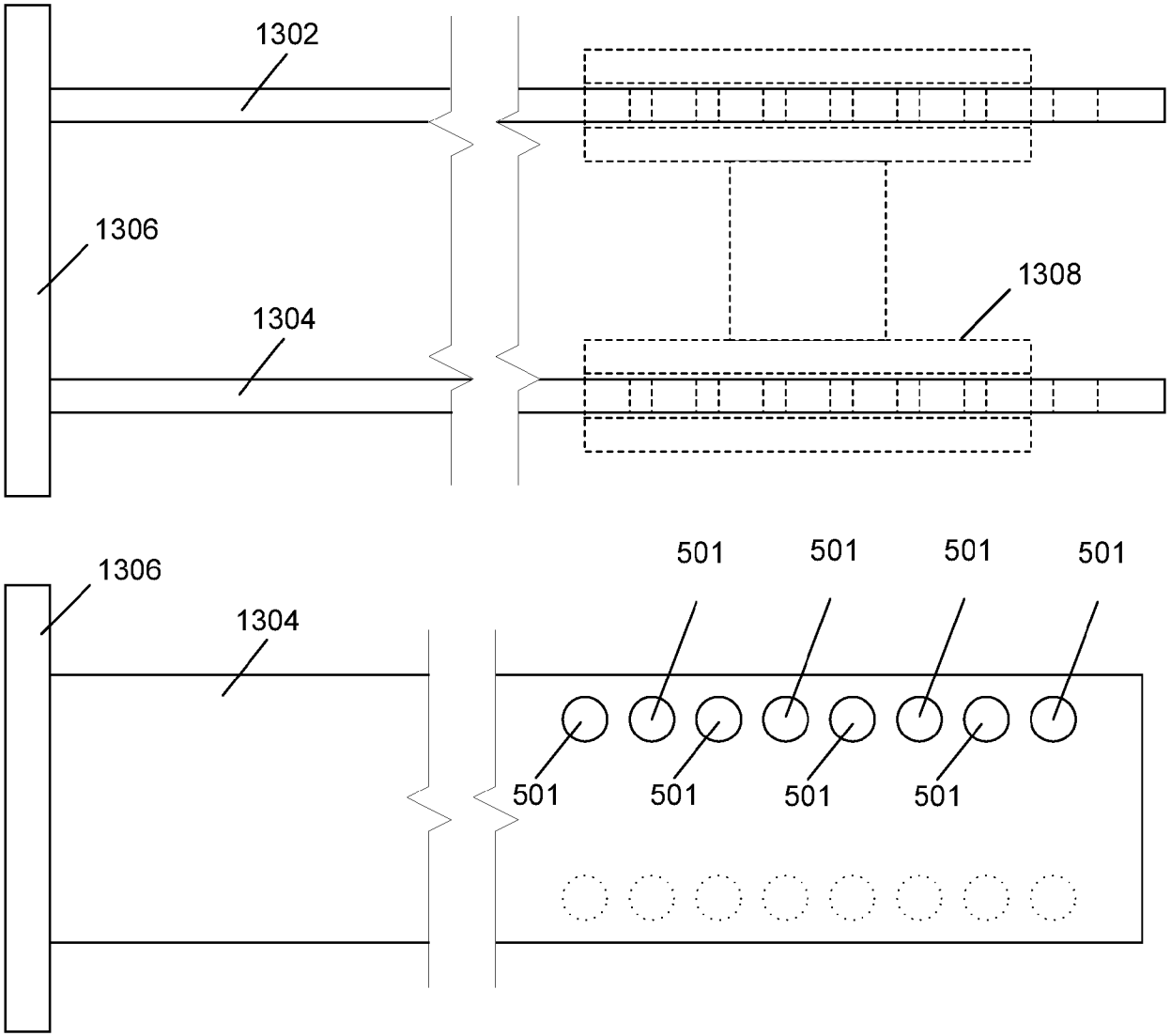
FIGS. 13A-13B respectively illustrate, in simplified form, a top and side view yet another alternative retaining bar implementation.

FIGS. 13A-13B respectively illustrate, in simplified form, a top and side view yet another alternative retaining bar 1300 implementation. As shown, this retaining bar 1300 is similar to those described above, but it includes two locking arms 1302, 1304, that are connected to each other by a connection plate 1306 in a spaced apart manner so that they can each be inserted into a different passageway of an engagement unit 1308 (shown in dotted lines) that includes two passageways (for example, like the one shown in FIG. 4). Note that, in this case, the retaining bar 1300 does not include an optional "leg" to engage the underside of the supporting plate of a container (although such a "leg" may be included in other implementations of such a retaining bar. In addition, depending upon the particular implementation only one, or both, of the locking arms 1302, 1304 could have at least one hole 501 to accept a lock as described herein, and likely more than one hole for versatility.

At this point it is to be understood and appreciated that the particular cross sectional shapes used for the locking arm and corresponding passageway, as well as where a passageway is located (i.e. in or on one or both of the plates) are a matter of design choice and may be influenced by the hook(s) and container(s) with which they may be used. Similarly, although the shaft 406 is shown as being substantially round and having an offset relative to the center of the plates it abuts, both its shape and the offset (if any) will also be a matter of design choice and may be a function of the hook(s) and container(s) with which it will be used. Likewise, the particular shape of the plates may similarly be a function of the hook(s) and container(s) with which they will be used.

In addition, it should be understood that, with respect to the lock, the term "lock" is intended to mean any type of locking mechanism that can be attached through the hole(s) and prevent ready withdrawal of the locking arm under the relevant circumstances. Thus, for example, under certain circumstances even one or more bolt/nut combinations could serve as a "lock" in a particular instance, provided removal would require a more than acceptable amount of time or effort within the context it is used.

Finally, it should be noted that, in all cases, it is intended that the engagement unit and retaining bar will be made of sufficient thicknesses, and of material(s) of sufficient hardness and strength, that removal or destruction by cutting, heating, cooling or impact cannot easily and quickly be achieved. Thus, suitable materials for the engagement unit and retaining bar can include hardened steel, titanium, and other appropriately hard metals and alloys, the section of which is well within the skill in the art once the likely use specifics are known. In similar vein, it is presumed that a suitably strong lock will also be used in this regard.

It should be understood that this description (including the figures) is only representative of some illustrative embodiments. For the convenience of the reader, the above description has focused on a representative sample of all possible embodiments, a sample that teaches the principles of the invention. The description has not attempted to exhaustively enumerate all possible variations. That alternate embodiments may not have been presented for a specific portion of the invention, or that further undescribed alternate embodiments may be available for a portion, is not to be considered a disclaimer of those alternate embodiments. One of ordinary skill will appreciate that many of those undescribed embodiments incorporate the same principles of the invention as claimed and others are equivalent.

What is claimed is:

1. An anti-theft device for use on a hook affixed to a plate of a carting container, the hook being located in a recess of the carting container, the anti-theft device comprising:

A) an engagement unit including a shaft dimensioned to occupy an engagement portion of the hook, a first plate coupled to one end of the shaft, the first plate including a passageway associated therewith, and a second plate coupled to an other end of the shaft; and B) a retaining bar including a stop plate, a locking arm coupled to the stop plate and having at least one hole therein dimensioned to accept a shackle of a lock, the locking arm being dimensioned in transverse cross section such that a distal end of the locking arm can be inserted into and through the passageway of the engagement unit, the locking arm further having a length such that, when the distal end has been inserted through the passageway, the stop plate will be on one side of the engagement unit and the at least one hole will be on the other side of the engagement unit.

2. The anti-theft device of claim 1, wherein the stop plate includes a portion configured to engage the hook support plate of the carting container.

3. The anti-theft device of claim 1, wherein the locking arm has a transverse cross sectional shape that is one of: substantially rectangular, substantially square or substantially circular.

4. The anti-theft device of claim 1, wherein the passageway is a first passageway and the second plate includes a second passage way associated therewith.

5. The anti-theft device of claim 1, wherein the locking arm has at least one notch to allow the locking arm to accommodate a hidden shackle lock.

6. The anti-theft device of claim 1, wherein the at least one hole is located near a top of the locking arm.

7. The anti-theft device of claim 1, wherein the at least one hole is located near a bottom of the locking arm.

8. The anti-theft device of claim 7, wherein the locking arm has at least one notch to allow the locking arm to accommodate a hidden shackle lock.

9. The anti-theft device of claim 1, wherein the length is such that, when the anti-theft device is attached to the hook of the carting container, the distal end of the locking arm will be close to a back wall of the recess.

10. The anti-theft device of claim 9, wherein the at least one hole is located close to the back wall.

11. The anti-theft device of claim 9, wherein the stop plate includes a portion configured to engage the plate of the carting container.

12. The anti-theft device of claim 1, wherein the at least one hole comprises multiple holes spaced along the length of the locking arm.

13. The anti-theft device of claim 12, wherein the locking arm is a first locking arm, and wherein the anti-theft device further comprises a second locking arm coupled to the first locking arm.

14. The anti-theft device of claim 1, wherein the passageway has a first shape and the locking arm has a transverse cross section closely corresponding to the first shape.

15. The anti-theft device of claim 1, wherein the passageway has a first shape and the locking arm has a transverse cross section that is different from the first shape.

16. The anti-theft device of claim 1, wherein the locking arm is a first locking arm, and wherein the anti-theft device further comprises a second locking arm.

17. The anti-theft device of claim 1, wherein the anti-theft device is positioned on the carting container such that:

the shaft occupies the engagement portion of the hook;

the first plate is on one side of the hook;

the second plate is on an other side of the hook;

a portion of the locking arm is contained within the passageway and the at least one hole is located within the recess, between a tip of the hook and a back end of the recess.

18. The anti-theft device of claim 17, further comprising a lock having a portion passing through the at least one hole.

19. The anti-theft device of claim 18, wherein the lock is one of a padlock or a hidden shackle lock.

20. The anti-theft device of claim 18, wherein the stop plate includes a portion positioned on a side of the hook support plate of the carting container that is opposite the side containing the hook.

* * * * *